US005660401A

United States Patent [19]

Yi

[11] Patent Number: 5,660,401

[45] Date of Patent: Aug. 26, 1997

[54] SKATEBOARD HAVING IMPROVED TURNING CAPABILITY

[76] Inventor: Young K. Yi, 556 19th St., Brooklyn, N.Y. 11218

[21] Appl. No.: 315,124

[22] Filed: Sep. 28, 1994

Related U.S. Application Data

[63] Continuation-in-part of Ser. No. 75,214, Jun. 9, 1993, abandoned.

[51] Int. Cl.[6] ..... A63C 17/06

[52] U.S. Cl. ..... 280/11.22; 280/87.042; 280/11.28; 280/809

[58] Field of Search ..... 280/11.22, 11.23, 280/11.27, 11.28, 87.041, 87.042, 842, 809, 819, 11.2, 826; 301/5.7

[56] References Cited

U.S. PATENT DOCUMENTS

| | | | |
|---|---|---|---|
| 3,627,172 | 12/1971 | Goodwin | 280/11.2 |
| 4,106,786 | 8/1978 | TAlbott | 280/87.042 |
| 4,391,456 | 7/1983 | Moor | 280/821 |
| 4,795,181 | 1/1989 | Armstrong | 280/87.042 |
| 4,865,342 | 9/1989 | Kong | 280/87.042 |
| 5,125,687 | 6/1992 | Hwang | 280/87.042 |
| 5,163,710 | 11/1992 | Chirtel et al. | 280/809 |
| 5,419,570 | 5/1995 | Bollotté | 280/87.042 |

*Primary Examiner*—Richard M. Camby
*Attorney, Agent, or Firm*—Boniard I. Brown

[57] ABSTRACT

A skateboard has a row of rollers, with a rear roller of relatively larger diameter for improved ground contact during turning maneuvers. Rollers are pivotally mounted for steer-ability, preferably being mounted on inclined axes for the effecting of turning torque about the axes in desired directions in response to exertion by a person of downward force on selected side portions of the skateboard, whereby improved turning of the rollers in desired directions is provided. A roller may be mounted on a pivotable yoke with the roller mounted on one end portion and a spring retainer on the other, so that upon a roller encountering an obstruction, bump or depression, the roller moves upwardly or downwardly to pivot the retainer against a spring, and impact energy is absorbed. Improved propulsion poles are provided, each pole having a generally transverse handle adapted for improved manual grasping and exertion of downward force against a supporting surface; a deformable pole tip member provides improved engagement with a ground surface in various pole orientations.

25 Claims, 9 Drawing Sheets

SKATEBOARD HAVING IMPROVED TURNING CAPABILITY

RELATED APPLICATIONS

This application is a continuation-in-part of application Ser. No. 08/075,214, filed Jun. 9, 1993 now abandoned.

BACKGROUND OF THE INVENTION

The present invention relates to an improved skateboard having a platform and a single row of rollers mounted on the undersurface of the platform for rollably supporting the platform on a relatively hard surface, such as hard ground, a street or sidewalk, etc. A person may stand on the platform and propel it forwardly with the aid of poles, somewhat like the propelling motions in cross-country skiing.

U.S. Pat. No. 4,865,342 to Kong shows a skateboard comprising a platform, a front caster wheel, and a rear non-steerable wheel, and a friction brake pad behind the non-steerable wheel. The person stands with both feet on the platform, while thrusting two poles against a pavement surface, thereby propelling the board forwardly. The person can stop the skateboard by shifting his weight rearwardly on the platform to tilt the platform rearwardly to bring the brake pad into frictional engagement with the pavement surface. The poles serve as propulsion devices and also as steadying devices to prevent the person from falling off the platform.

The skateboard of this patent relies on two wheels for stability. With such an arrangement, the wheels have insufficient frictional contact with the supporting surface adequately to stabilize the skateboard, especially during turning maneuvers. A skateboard having a greater number of support wheels provides a greater degree of stability.

U.S. Pat. No. 5,125,687 to Hwang shows a skateboard in many respects similar to that of U.S. Pat. No. 4,865,342. The board has two additional outboard rollers located near opposite side edges of the board, i.e., spaced from the board centerline. The skateboard of this patent is inherently safer and more stable than the board of U.S. Pat. No. 4,865,342. However, the presence of the two additional rollers makes it more difficult to turn and maneuver the skateboard, because the additional rollers prevent the board from tilting in the transverse, side-to-side directions. When a person shifts his weight laterally (transversely) to execute a turning maneuver, the skateboard does not fully respond to the weight shift, and the skateboard is not easily turned.

U.S. Pat. No. 3,622,172 to Goodwin shows a roller type land ski adapted to support only one of a person's feet. The person uses two skis to ski down a sloping surface. Clamping devices are provided on each ski for attaching the ski to a person's ski boot. These land skis are apparently used in the manner of conventional winter snow skis.

In the land ski of the Goodwin patent, frictional resistances are overcome by a single row of rollers carried on the undersurface of each ski, and a frictional brake is carried at the rear end of each ski. The person can bring the brake into frictional engagement with the ground surface by shifting his weight rearwardly, thus to tilt the ski downwardly in a rearward direction, There has existed a need for skateboards capable of effecting turning of rollers in response to a person's exertion of downward force on portions of the skateboard to provide better turning and maneuvering capabilities, and there has existed a need for effective shock-absorber means for absorbing impact energy upon skateboard rollers encountering bumps, obstructions, depressions, etc.

SUMMARY OF THE INVENTION

The present invention relates to a skateboard having a platform for supporting a person and a row of rollers mounted thereon. The rollers are preferably formed of deformable material for improved relatively large contact surfaces. A rear roller is preferably of larger diameter than other rollers, and has larger ground contact surface, thus to serve as primary ground contact during turning maneuvers when other rollers are elevated, thus to effect minimum resistance to turning.

The invention provides rollers which are swivelable about pivot means. The rollers are turned or steered in response to downward force exerted by a person on selected portions of the skateboard. The rollers are preferably pivotable about inclined pivot pin means, and torque or turning force is produced about the inclined axis of the pivot pin means upon the exertion of downward force by a person on a left or right side portion of the skateboard platform, relative to the direction of forward movement, thus to produce a turning of the rollers in a desired left or right direction of turn.

A shock-absorber mechanism is provided for a roller wheel, and comprises a yoke pivotally mounted on frame members and having one end portion defining a retainer or spring means disposed between the retainer and the frame, with the opposite end portion of the yoke being bifurcated with a roller between its bifurcated arms. Upon the roller encountering a bump or obstruction, the roller receives the impact energy and is pivoted with the yoke to urge the retainer section to compress the spring; upon the roller encountering a depression, hole or the like, the roller moves downwardly to pivot the yoke retainer section upwardly to decompress the spring means. Impact energy is thus not transmitted to the skateboard and the ride with person thereon is cushioned.

Improved propulsion poles are provided. The pole may preferably comprise separable components of appropriate length for packing and carrying, as with skis or other equipment. Improved handle features provide for better grasping and improved manual application of force via the pole to a supporting surface. An improved, deformable cap member at the tip of the pole is provided with a substantial flat end surface to maintain good surface contact for stability while the cap member is deformed in various orientations to accommodate different orientations of the pole relative to a supporting surface.

DESCRIPTION OF A PREFERRED EMBODIMENT OF THE INVENTION

Figure 1:
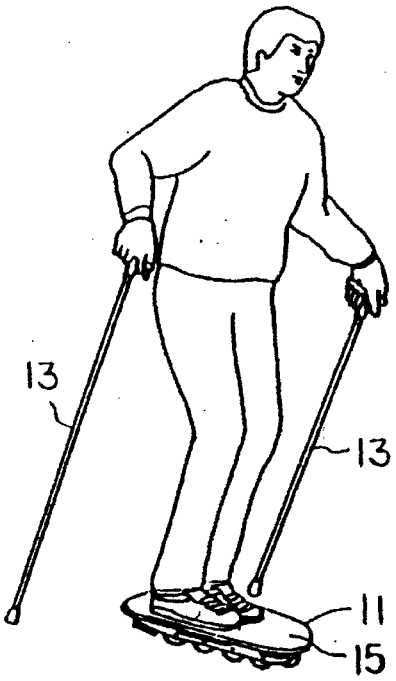
FIG. 1 is a perspective view showing a person propelling himself forward on a skateboard according to the invention.

Referring to FIG. 1 of the drawings, a person standing on a skateboard of the present invention, and grasping the handle portions of two propulsion poles 13 so that he can propel himself along a supporting surface. The lower ends of the poles are forcibly thrust against the sub-surface so that the reaction forces move the person's body forwardly. Rollers on the underside of the skateboard platform support the skateboard.

The skateboard comprises a platform 15 having a longitudinal central axis 17 (FIG. 7), a front end 19, a rear end 21, and two side edges 23. The transverse width of the platform is sufficient for a person to stand with both feet on the platform upper surface (FIG. 1).

A single row of rollers is mounted on the platform below the platform lower surface. A frame structure 26 is secured to the platform for mounting the rollers. The frame structure comprises two parallel walls 25 located on either side of longitudinal axis 17, and equidistant from axis 17, the rollers having their midplanes coincident with the central axis. Each wall 25 has a number of ears extending from its upper edge, whereby the wall is attachable to platform 15 by rivets or screws. The frame walls 25 are separate from platform 15, although the platform and frame structure may be integrally molded.

The single row of rollers comprises four rollers 29, each having a relatively small diameter 31 (FIG. 5), and a fifth roller 33 of relatively large diameter 35, preferably about one and one-half times the diameter of each roller 29. Typically, the diameter of roller 33 is about three and three-quarter inches and the diameter of each roller 29 is about two and one-half inches.

Figure 7:
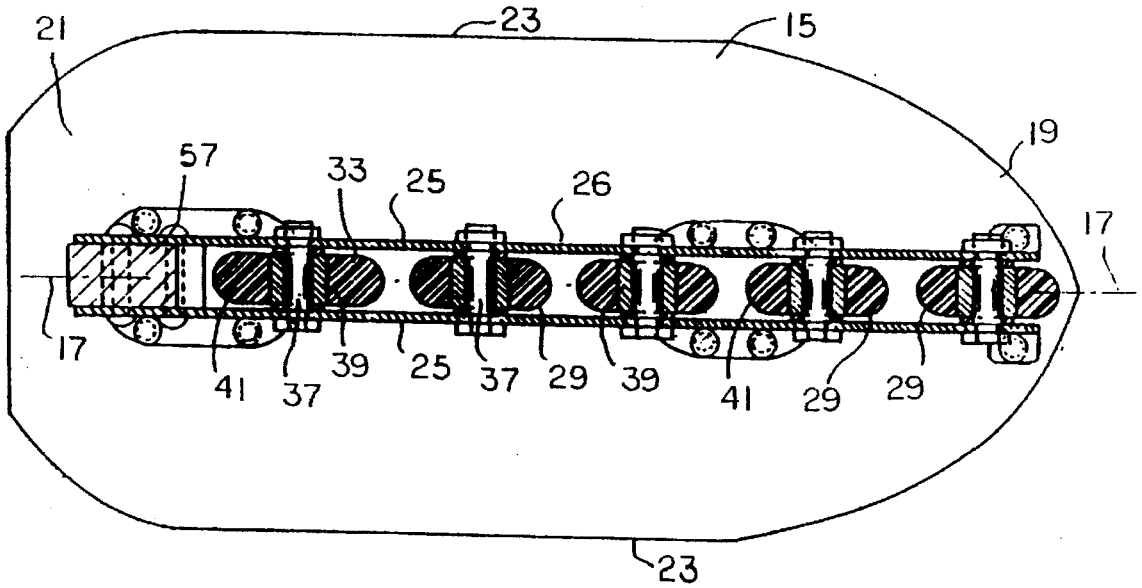
FIG. 7 is a sectional view of the FIG. 5 skateboard, viewed upwardly toward the skateboard platform.

The rollers ay be constructed and mounted in various ways. As shown in FIG. 7, each roller has a fixed axle in the form of a bolt 37. A nut is threaded onto each bolt to secure it in fixed position extending through and between walls 25. Circular holes are pre-drilled through walls 25 to mount bolts 37. An anti-friction bearing sleeve 39 is rotatably positioned on each bolt to form a mounting surface for an annular roller body 41 formed of a deformable material, e.g., a reasonably high durometer rubber compound or a polyethylene plastic. The roller body is freely rotatable on its associated axle 37. Roller body 41 is deformable under the person's weight, thereby presenting a reasonably large footprint on the supporting surface, i.e., pavement, sidewalk or hard ground.

Figure 8:
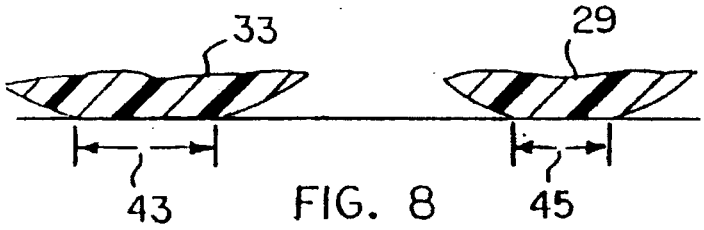
FIG. 8 is a fragmentary view showing deformations of two differently sized rollers of the FIG. 5 skateboard.

FIG. 8 illustrates the relative sizes of the footprints of the differently sized rollers 29 and 33. The larger diameter roller 33 has a relatively large contact area or footprint 43, whereas each of the smaller diameter rollers 29 has a relatively smaller contact area 45. The difference in contact area is a feature of the present invention. It enables the skateboard to be turned leftward or rightward with relatively little effort on the part of the person standing on the platform.

Figure 5:
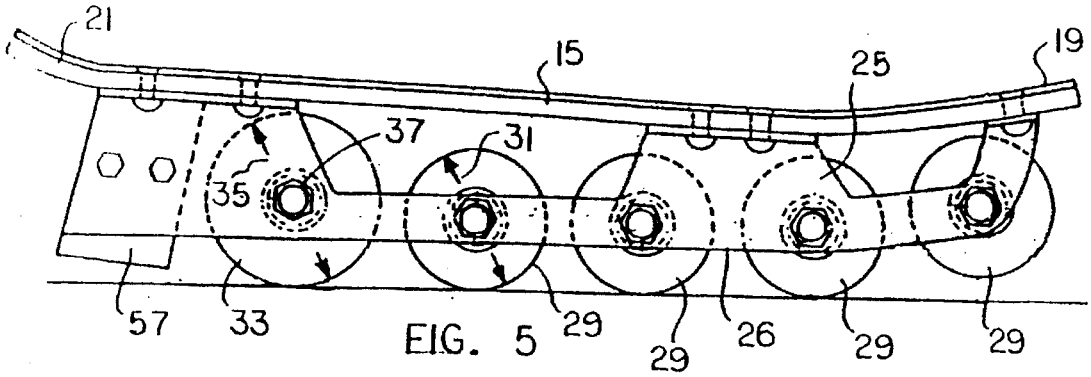
FIG. 5 is an enlarged elevational view of the skateboard of FIG. 1.

When the person intends to move forwardly without turning, he stands with his weight approximately evenly applied to roller 33 and the three rollers 29 in front of roller 33, the frontmost roller 29 being elevated above the ground surface. FIG. 5 illustrates the roller positions during straight ahead movement of the skateboard. When the person desires to turn the skateboard rightward or leftward, he shifts his weight slightly rearwardly, thereby placing a greater proportion of the weight on the rear roller 33. The platform thus tilts slightly downwardly and rearwardly to somewhat decrease the contact pressure of the three rollers 29, and to somewhat increase the contact pressure of the rear roller 33. Decrease in the contact pressure on the three rollers 29 reduces the size of each footprint 45 (FIG. 8) so that the three small diameter rollers 29 offer minimal frictional resistance to the turning maneuver. The turning force may be provided by the person shifting his weight laterally in the turning direction, while at the same time thrusting the associated pole 13 against the supporting surface to provide a pivot anchorage about which to turn. When turning rightward, the right pole is used as a pivot, and when turning leftward, the left pole is the pivot. For relatively slight or gradual turns, it may not be necessary to use the poles 13.

The front roller 29 is elevated above the three other rollers 29 so that it is not involved in normal turning actions. The front roller provides a safety function to prevent overturning of the skateboard if the person should lean forward appreciably. The elevated front roller facilitates passage of the skateboard over obstacles by engaging an obstacle first to provide a lead-in to facilitate engagement of the other rollers to pass over such obstacle. The front roller may also be used for fast or acrobatic turning maneuver by the person shifting his weight forwardly onto the toes so that only the two frontmost rollers are in contact with the supporting surface.

Disregarding the frontmost elevated rollers, which may be considered optional, the skateboard will have one rear roller 33 and at least three other rollers 29 arranged in a single row coincident with the longitudinal axis of the skateboard platform. During a turning maneuver, the skateboard platform will usually tilt transversely as the person's weight shifts in the turning direction. The three small diameter rollers 29 will usually have some frictional contact with the supporting surface to prevent the skateboard from sliding laterally out from beneath the person's feet. Each roller has a convex arcuate edge profile (FIG. 7), such that the three small diameter rollers have sufficient ground contact to stabilize the skateboard against lateral slippage during a turning action. However, rear roller 33 provides the primary gripping action on the supporting surface during a turning action, thus to enable the negotiation of a turn without having to skid rollers 29 along the sub surface. The person's weight is concentrated significantly on the rear roller 33, whereby a turn can be accomplished with relatively small effort.

Figure 6:
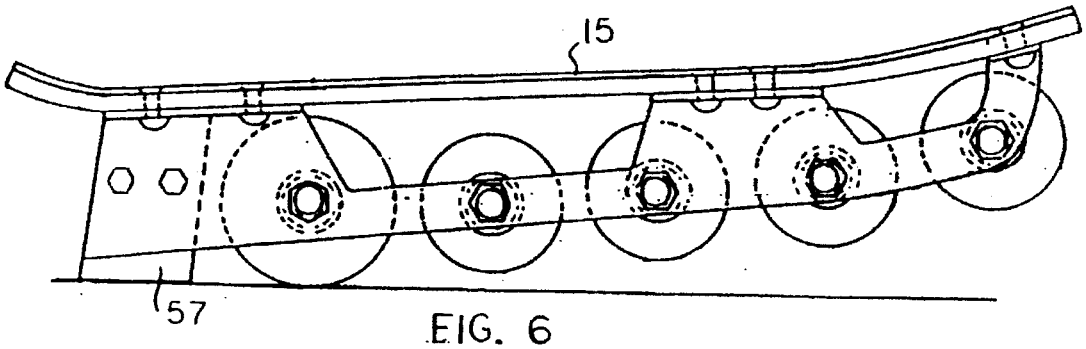
FIG. 6 is a view similar to that of FIG. 5, with the board component tilted to achieve a braking action.

In its preferred form, the skateboard has frictional brake means, whereby the skateboard user can stop or slow the skateboard motion as circumstances may require, e.g., on steep slopes. In the embodiment of FIGS. 6 and 7, the brake means comprises a block 57 of wear-resistant material mounted between walls 25 at the rear end of platform 15. The lower face of block 57 is inclined to the horizontal when the skateboard is in its normal operational mode (FIG. 5). The person can operate the brake by shifting his weight rearwardly on platform 15 so that the lower face of block 57 is brought into frictional contact with the pavement or other supporting surface, as shown in FIG. 6.

Figure 2:
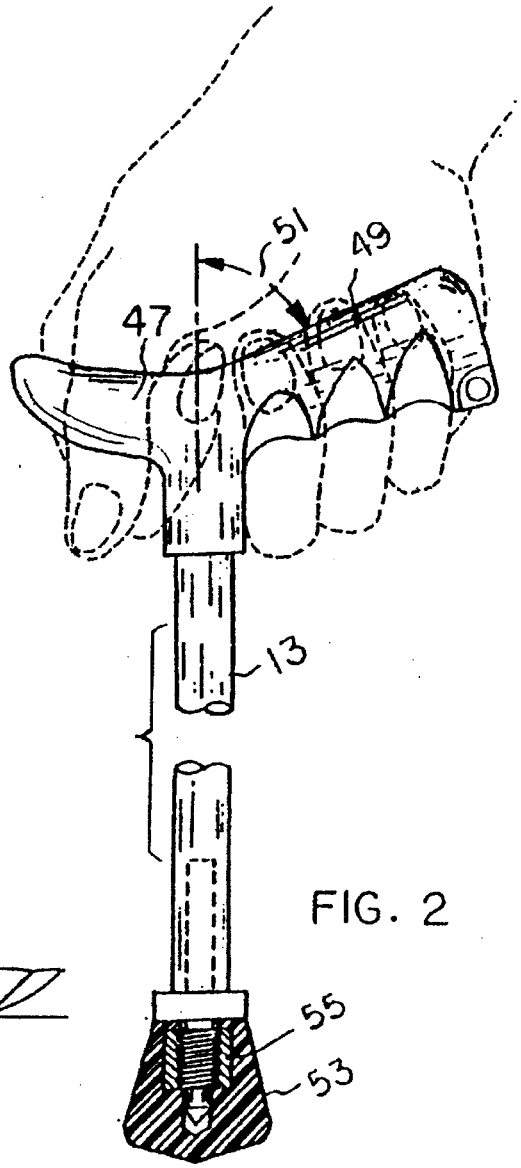
FIG. 2 is an elevational view of an improved propulsion pole that may be utilized with the invention, showing in broken lines the manual grasping of the handle thereof.
Figure 3:
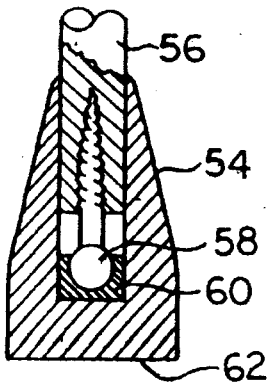
FIG. 3 is a fragmentary view, showing a deformable pole cap which may be utilized with the invention.
Figure 4:
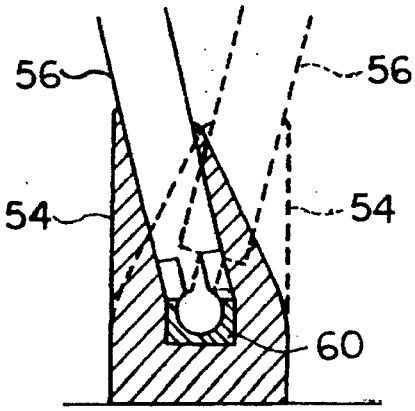
FIG. 4 is a view, similar to that of FIG. 3, showing the deformable cap of FIG. 3 in different configurations during use.

FIGS. 2, 3 and 4 illustrate a preferred pole construction for use with the present invention. Handle 47 extends generally transversely of the pole with its upper surface 49 inclined at an angle 51 with the shaft axis of about seventy-five degrees. The user grasps the handle with his hand encircling the handle surface and with the shaft between the first and second fingers (FIG. 2). The shaft is then approximately aligned with the user's forearm so that the person can use his forearm effectively to exert a substantial downward force and a rearward thrust force against the ground surface. The handle is adapted to facilitate a reasonably good propelling force without excessive stress on the user's wrist, arm or shoulder.

As shown in FIG. 3, the handle has a relatively short front section extending forwardly of the pole axis, and a longer rear section extending rearwardly of the pole axis. The person grips the handle as he might grip the handle of a handgun, with the palm of the hand resting on the handle upper surface. The front finger of the person's hand encircles the front section of the handle, and the last three fingers of the hand encircle the rear section of the handle. The line of action of the person's forearm is generally coincident with the pole axis, with the propelling force being exerted through the palm area of the person's hand so as to minimize stress on the person's wrist.

The lower end of the pole may have a deformable cap 53 thereon formed of rubber or polyethylene. A metal insert 55 embedded in the cap may be unscrewed from the pole to permit removal of the cap.

Figure 2A:
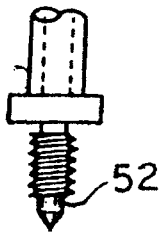
FIG. 2A is a fragmentary view of the tip portion of the pole of FIG. 2.

As shown in FIGS. 2 and 2A, the pole 13 has mounted in its end portion a conical tip 52 for thrusting into the surface of ice or other surfaces too slippery for non-slip engagement with a pole cap, such as cap Referring to FIGS. 3 and 4, a deformable cap member 54, preferably formed of rubber or appropriate plastic material, has a generally cylindrical recess for receiving the end portion of a pole 56 with a ball element 58 threadedly mounted therein, and a bearing member 60 having a spherical recess for swivelly receiving the ball member 58, as shown. A flat bottom surface 62 of the deformable cap provides substantial area contact with s supporting surface upon downward pressure by the pole, when the pole is oriented in various attitudes relative to the supporting surface, as indicated in FIG. 4, one pole orientation being shown in solid lines and another in broken lines.

Figure 16:
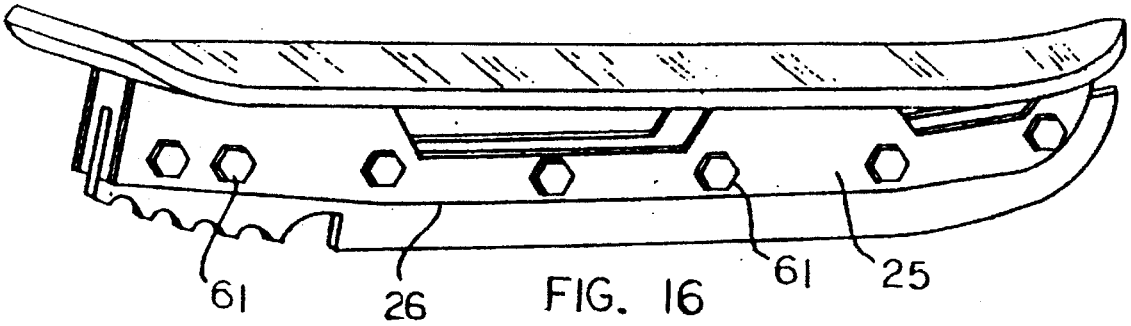
FIG. 16 is a perspective view similar to that of FIG. 5, but showing a ski structure for use on icy surfaces.
Figure 17:
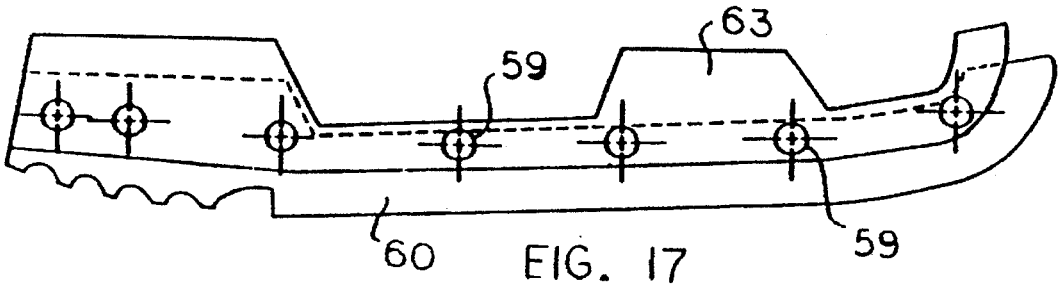
FIG. 17 is a side elevational view of the ski structure of FIG. 16.
Figure 18:
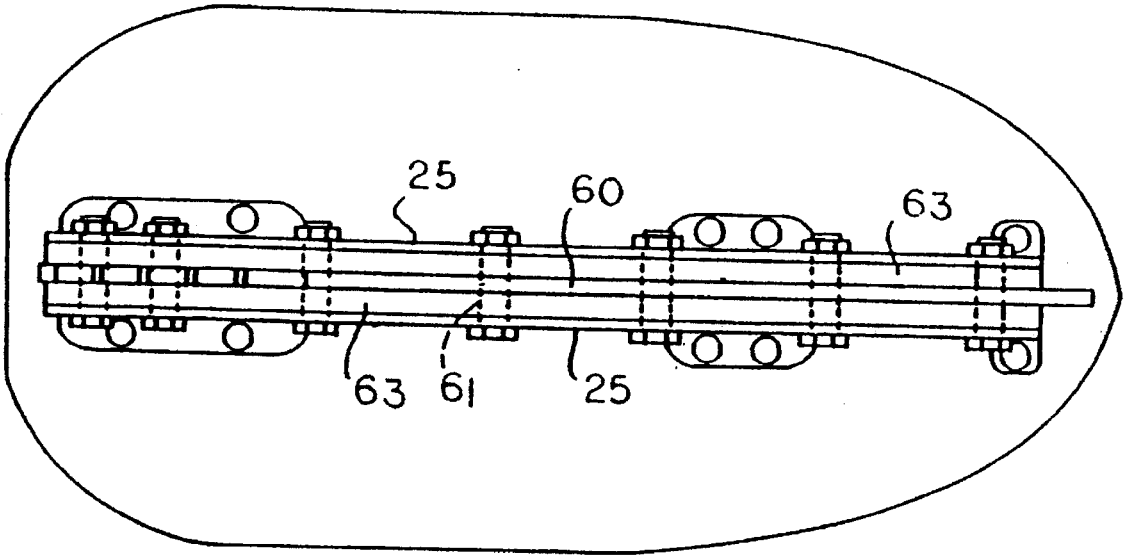
FIG. 18 is a bottom view of the FIG. 16 skateboard.
Figure 19:
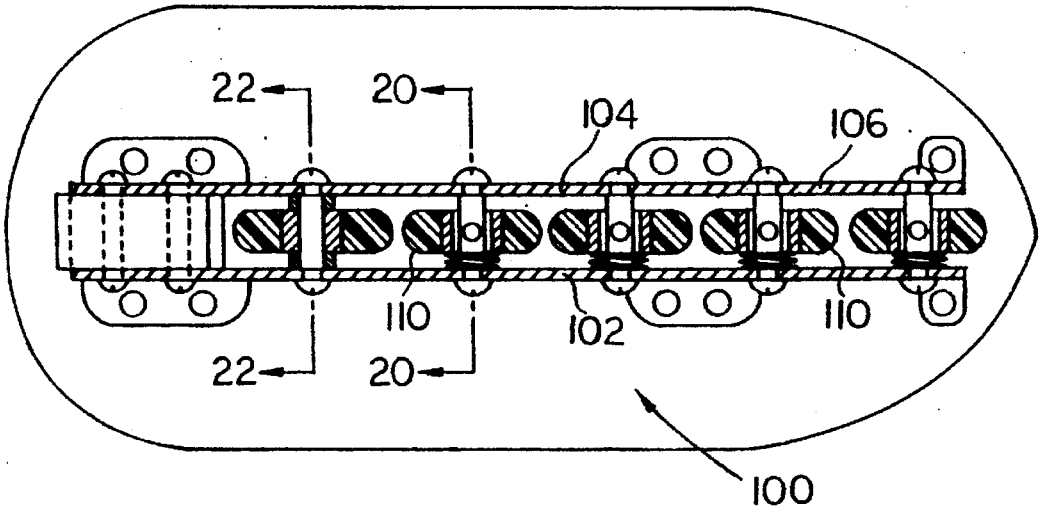
FIG. 19 is a bottom view, partially in section, showing another embodiment of skateboard assembly according to the present invention.

When it is desired to use the skateboard on icy surfaces, rollers 29 and 33 may be replaced by a ski structure shown in FIGS. 16 through 18. FIG. 17 shows the ski structure per se, and FIG. 16 and 18 show the ski structure installed on the skateboard. The ski structure 60 has transverse holes 59 spaced apart like the holes in walls 25 for mounting brake 57 and rollers 29 and 33. The ski structure can be positioned between walls 25 and secured by bolts 61 extending through the aligned holes. The ski structure includes side plates 63 that act as spacers, whereby the ski structure has a precise non-wobble fit against the facing surfaces of walls 25.

FIGS. 5 through 7 show a skateboard body equipped with supporting rollers, whereas FIGS. 16 through 18 show the skateboard body equipped with a supporting ski or skate. Conversion from one type of support to the other is relatively simple and convenient. Nuts are unthreaded from the bolts 37 to permit removal and replacement of the rollers with the ski, and vice versa. The frame structure is a fixed portion of the skateboard body, and need not be disturbed during the converting of the skateboard from one type of support to the other type support.

Figure 10:
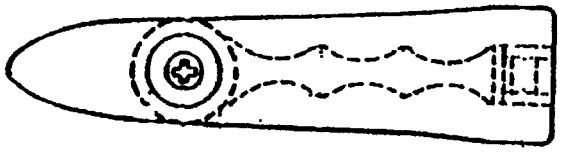
FIG. 10 is a top end view of the FIG. 9 propulsion pole.
Figure 9:
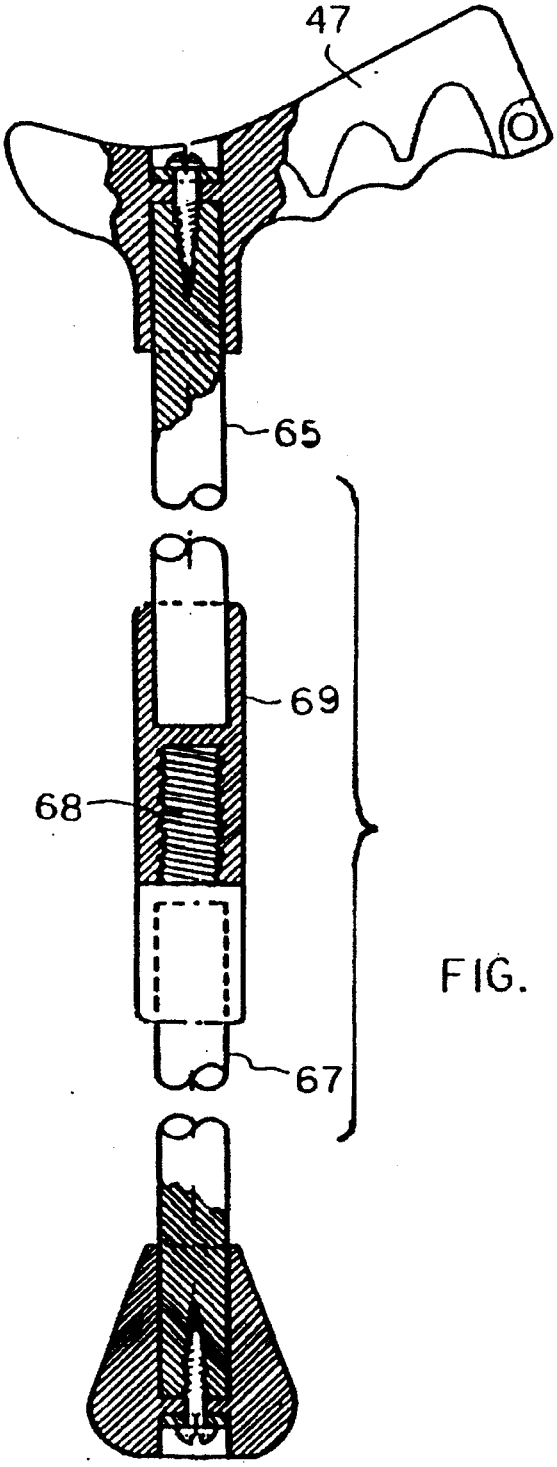
FIG. 9 is an elevational view, partially in section, of a propulsion pole which may be utilized with the present invention.

FIGS. 9 and 10 show ah alternate pole construction. The handle structure is basically like that of the embodiment earlier described. However, in the pole of FIGS. 9 and 10, the pole shaft is sectionalized so that the pole may be broken down into two relatively short sections. Each section may be approximately the length of the associated skateboard, whereby the pole sections may be packaged with the skateboard in a package not appreciably longer than the skateboard length. As shown in FIG. 9, the pole includes an upper shaft section 65, a lower shaft section 67 and a shaft connector 69. The shaft connector may be permanently attached to shaft section 65. Shaft section 67 has a threaded stem 68 threadable into a threaded socket in connector 69 to form a connection between the shaft sections. The connection can be unthreaded to form a smaller size package for storage or shipment.

Figure 11:
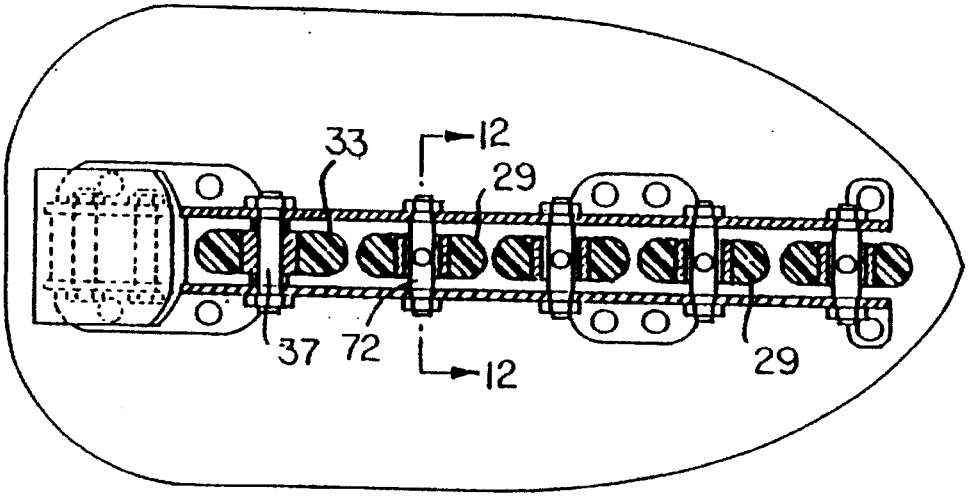
FIG. 11 is a view taken in the direction of FIG. 7, illustrating another embodiment of the invention.
Figure 12:
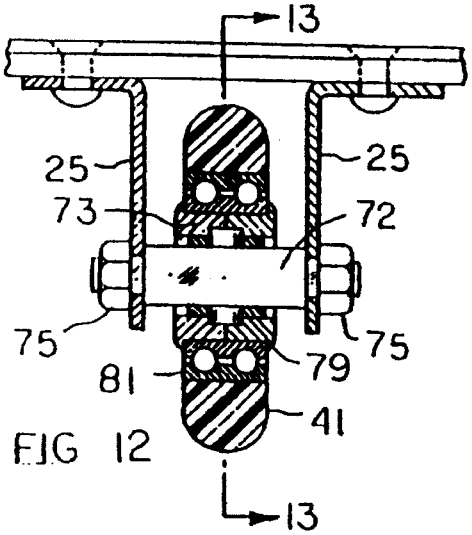
FIG. 12 is an enlarged partial sectional view taken on line 12—12 in FIG. 11.
Figure 13:
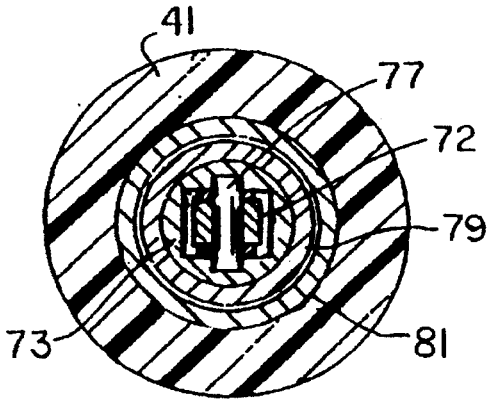
FIG. 13 is a sectional view taken on line 13—13 in FIG. 12.

FIGS. 11–15 show a modified form of the skateboard depicted in FIGS. 5–7. In the skateboard of FIGS. 11 through 15, the small diameter rollers 29 are steerable, and the large diameter roller 33 is non-steerable. Each roller 29 has an axle 72 that is flat-sided (FIG. 13) so that the axle has a clearance relative to a surrounding roller support sleeve 73; sleeve 73 is preferably a split sleeve structure as shown in FIG. 12. The axle has square sections fitting into square holes in walls 25, whereby the axle cannot turn. Nuts 75 are threaded onto the axle to clamp the axle in fixed position between walls 25.

Figure 14:
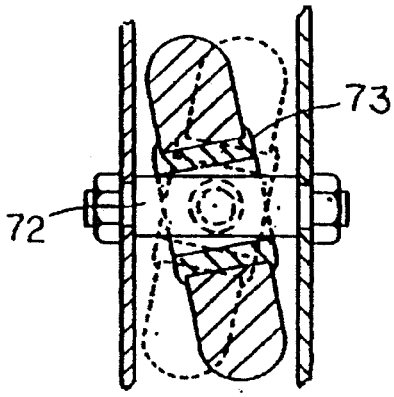
FIG. 14 is an enlarged partial sectional view showing the steering capability of the roller of FIGS. 12 and 13.
Figure 15:
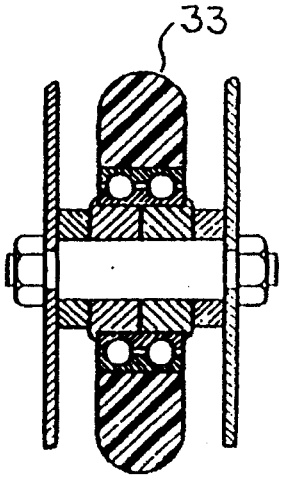
FIG. 15 s an enlarged partial sectional view of a non-steerable roller of the skateboard of FIG. 11.

Two vertically aligned circular sockets are defined in sleeve 73 to receive the ends of a pivot pin 77 that extends vertically through axle 72; each circular socket comprises two semi-circular cavities formed in the facing surfaces of the sleeve 73 sections. Washers may be placed on the flat faces of axle 72 and about pin 77 to minimize frictional forces. The sleeve can thus pivot about a vertical axis (FIG. 14). An anti-friction bearing is carried on sleeve 73 to enable the roller body 41 to rotate freely about the sleeve axis. The anti-friction bearing comprises an inner race 79, an outer race 81, and ball bearings in the raceway defined by the races.

The functioning of the FIG. 11 skateboard is essentially similar to that of the FIG. 5 skateboard, except that turning is somewhat easier, because the small diameter rollers 29 are steerable. Less weight shift is required to accomplish a steering maneuver. The large diameter roller 33 is a fixed-axis (non-steerable) roller to maintain the skateboard on track, i.e., stabilized, during straight-forward operation.

A principal feature of the invention is the employment of a single row of rollers on the skateboard longitudinal axis, with the rearmost roller in the row having a diameter appreciably larger than the other rollers in the row.

FIGS. 19 to 27 illustrate a preferred embodiment of the invention, which provides improved turning and maneuvering capabilities.

As in the earlier-described embodiment, a rear roller 111 is not swivelable, and serves to stabilize the skateboard, particularly in forward movement.

Figure 20:
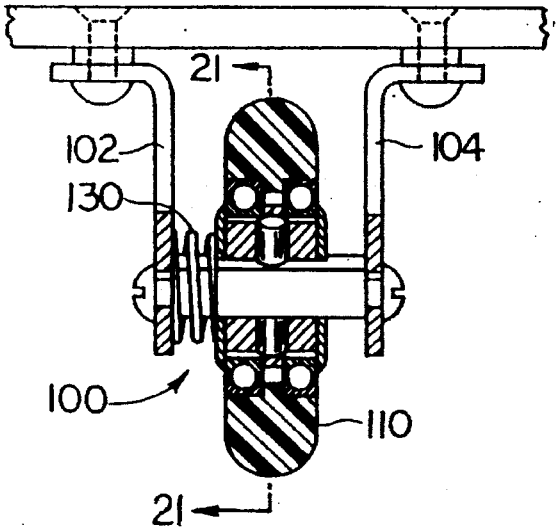
FIG. 20 is a sectional view taken at line 20—20 in FIG. 19, showing details of a roller assembly of the embodiment of FIG. 19.
Figure 21:
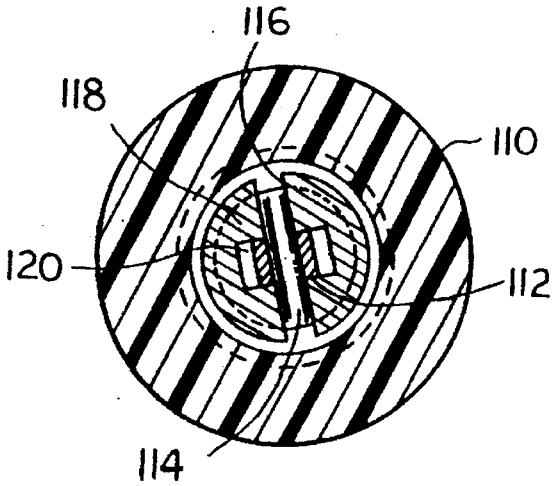
FIG. 21 is a sectional view taken at line 21—21 in FIG. 20.

As in the earlier-described embodiment, rollers 110 have axles 112 of generally rectangular cross-section, with reduced end portions, also of rectangular cross-section received in corresponding rectangular openings 108 (FIG. 27) in parallel walls 102, 104 of the frame 106, which openings are inclined relative to the skateboard surface and longitudinal axis. Each axle has therein a bore which is also inclined, and in which a pivot pin 114 extends, the pin also extending through an inclined diametrical bore in roller sleeve 118 (FIGS. 20, 21). A rectangular opening 120 is defined in the roller sleeve to provide clearance to provide relative movement of the components.

Figure 22:
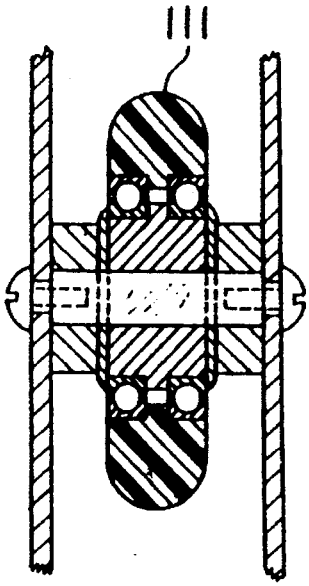
FIG. 22 is an elevational sectional view of a rear roller assembly, taken at line 22—22 in FIG. 19.
Figure 23:
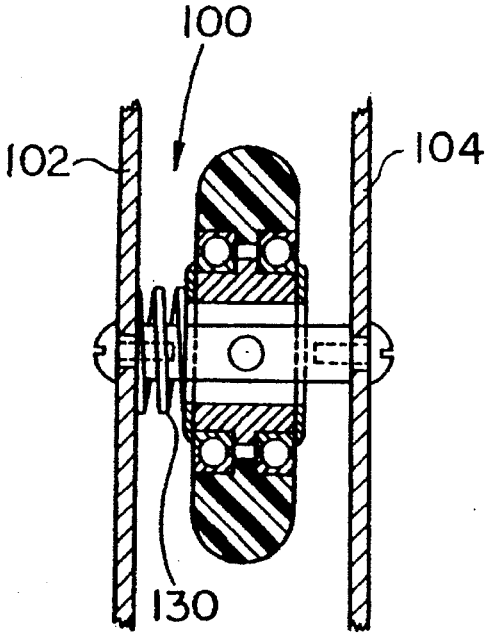
FIG. 23 is a sectional view, similar to that of FIG. 22, showing a cross-sectional view of a pivotally mounted roller according to the invention.
Figure 24:
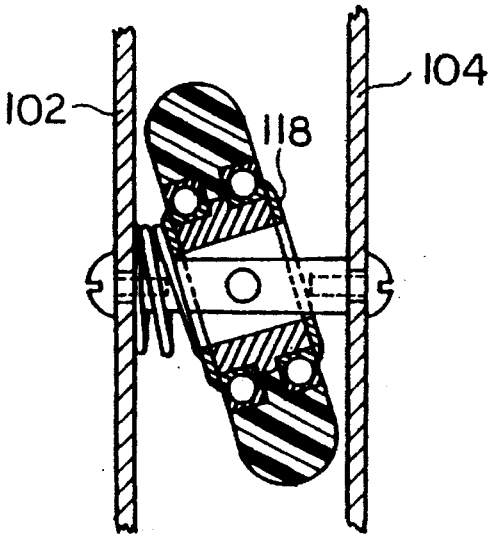
FIGS. 24 and 25 are views, similar to that of FIG. 23, but showing the configuration of components during left and right turns of the roller in turning the skateboard.
Figure 25:
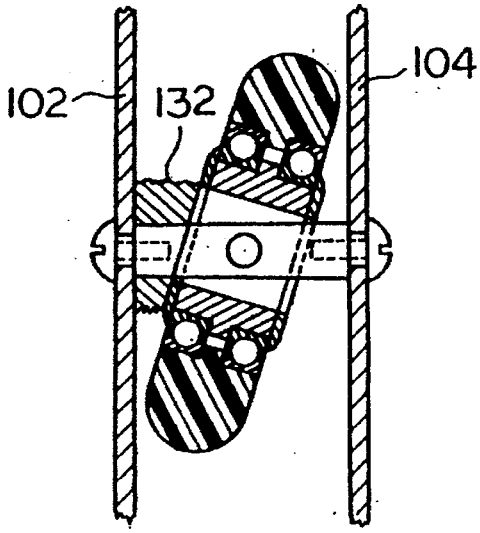
Figure 26:
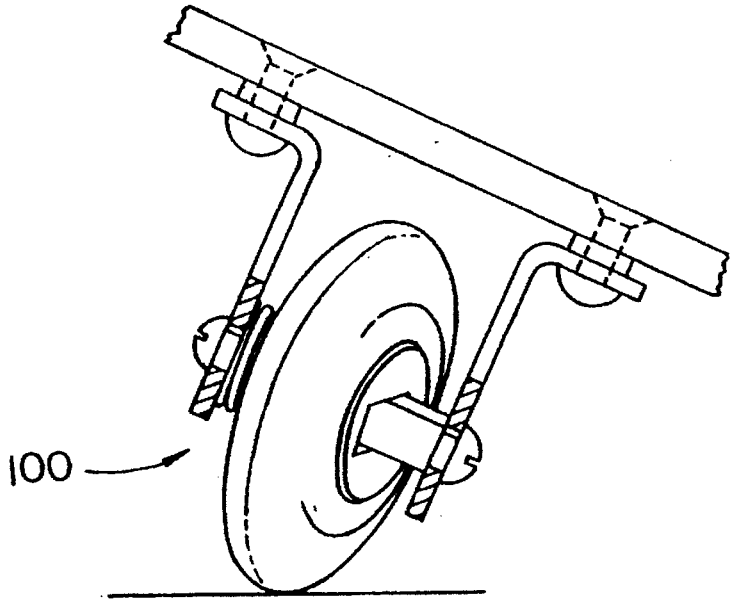
FIG. 26 is a partial perspective view, showing the tilting of the skateboard and the turning of the wheel of FIG. 25 in a right turn of the skateboard.
Figure 27:
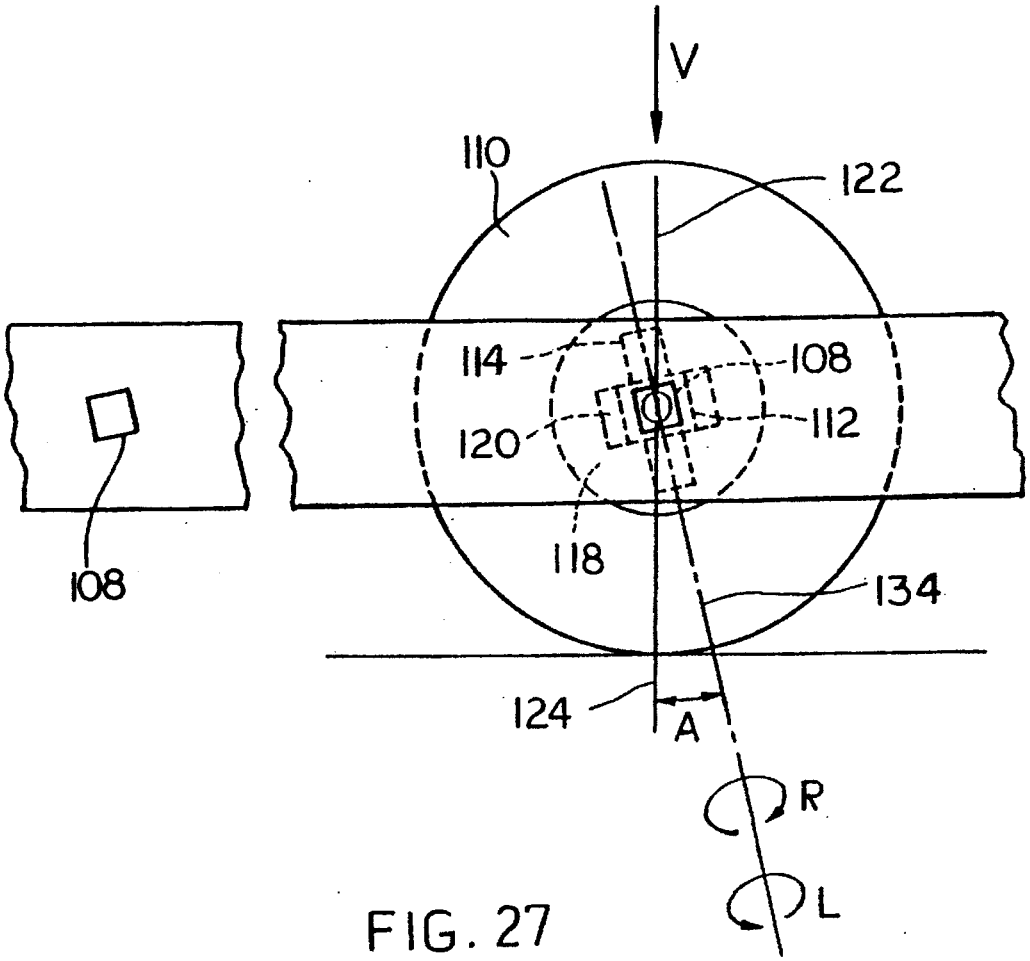
FIG. 27 is a diagrammatic showing of the configuration and orientation of components of the roller of FIGS. 20 and 21 in effecting application of turning torque to the roller.
Figure 28:
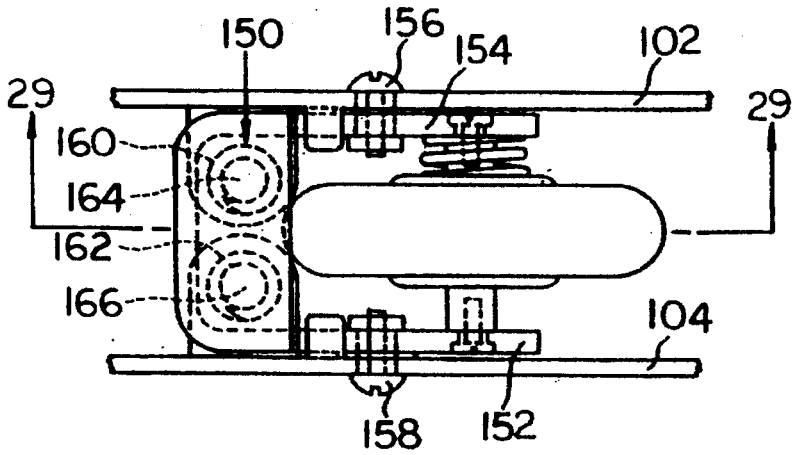
FIG. 28 is a plan view of a shock absorber mechanism which may be utilized with the present invention.
Figure 29:
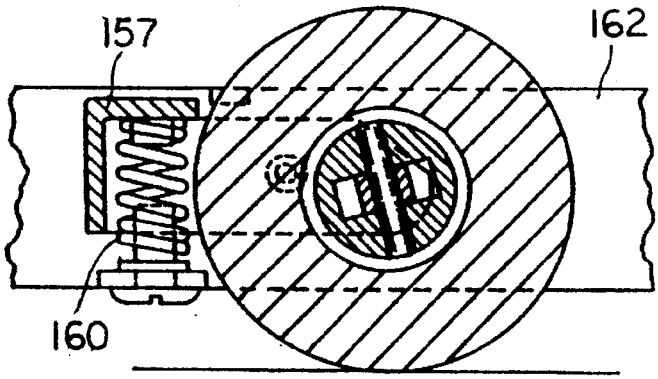
FIG. 29 is a sectional view taken at line 29—29 in FIG. 28.
Figure 30:
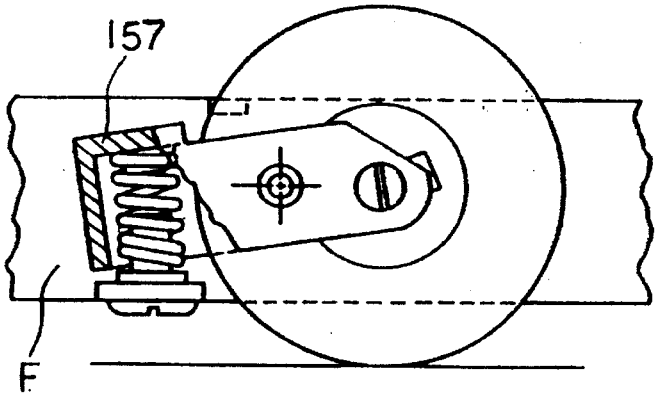
FIGS. 30 and 31 are views taken in the direction of FIG. 29, showing the components in different positions of operation.
Figure 31:
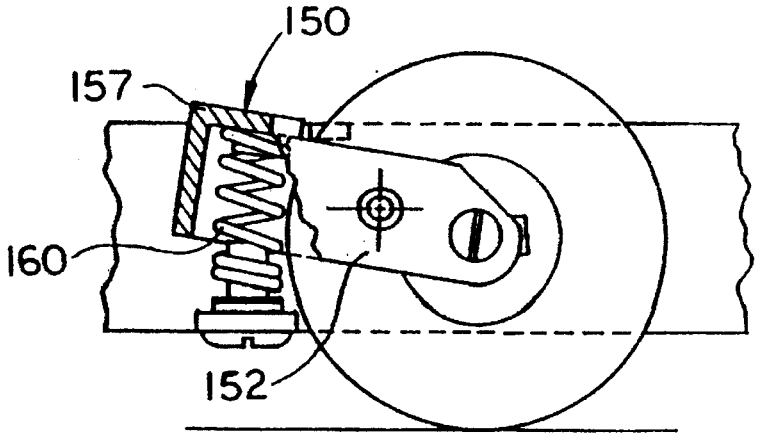

With the axes of the pivot pins inclined with the upper portions of the pins inclined forwardly in the direction of forward movement of the skateboard, as shown diagrammatically in FIG. 27 and indicated in FIGS. 22 and 23, each pin 114 is disposed at an angle relative to a line 122 extending between the axis of the roller and a point of contact 124 of the roller with a supporting surface, such as a ground surface, and relative to the skateboard platform and its longitudinal axis.

A spring 30, or other resilient member, such as rubber member 132 (FIG. 25) is mounted between each wheel and a supporting framewall, such as wall 102, as shown, thus to maintain the roller steady and prevent wobbling during movement and pivoting in turns, etc.

Referring to the diagrammatic showing of FIG. 27, will be understood from the geometry and coaction of the components, including the pivotal movement of the sleeve 118 about pivot pin 114, that upon the exertion of downward force by a person on a selected side portion of the skateboard, for example the left side, a torque or turning force is exerted on the roller about axis 134 of the pivot pin 114 in the direction of circular arrow L, as viewed from above (arrow V). Thus the wheel, and the other wheels, are turned leftwardly relative to the direction of forward movement of the skateboard, thereby greatly facilitating turning and maneuverability. Upon exertion of downward force on a right side portion of the skateboard, torque or twisting moment is indicated about the pivot pin axis 134 in the direction indicated by circular arrow R, thus to turn the wheel rightward to facilitate right turning, with improved maneuverability.

This production of turning torque on rollers is analogous to the turning of a bicycle front wheel by a rider leaning leftward or rightward to tilt the-bicycle, without turning the handlebars, thus to effect a left or right turn with turning torque or twisting force being effected about an inclined axis between the handlebar's center, along an inclined yoke, the axle of the wheel mounted on the yoke.

FIGS. 28 to 31 illustrate a shock-absorber mechanism 150 for use with skateboards of the invention. For each roller with which the shock-absorber mechanism is utilized, a yoke 152 is pivotally mounted on the frame walls, with each of two bifurcated arms 152, 154 pivotally mounted on bolts 156, 158 which extend through frame walls 102, 104, as shown. The distal end of the yoke comprises a retainer section 157 for retaining springs 160, 162, which are engaged on bolts 164, 166. The bolts are threadedly secured in frame F to provide adjustment of spring compression.

Upon a roller encountering a bump or obstruction, or the landing of the skateboard on a surface after leaving a supporting surface, the roller receives the impact energy and is pivoted with the yoke about bolts 156, 158 to move the roller upwardly and move retainer section 157 downwardly to compress the spring. Impact energy is thus absorbed and not transmitted to the frame and to the skateboard, thereby rendering smoother the person's ride on the skateboard.

When a roller encounters a depression, hole or the like (FIG. 31), the roller moves downwardly, and the yoke 152 pivots to move its retainer section 157 upwardly to effect decompression of the springs, thus to absorb impact energy and to cushion and make smoother the person's ride on the skateboard.

Thus there has been shown and described a novel skateboard having improved turning capability which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A skateboard comprising:

a platform having a longitudinal axis, an upper surface, a lower surface, and a front and rear ends, a frame structure extending downwardly from the platform lower surface, friction brake means carried by said frame structure near the rear end of the platform, and a single row of rollers supported on said frame structure on said longitudinal axis of the platform, said single row of rollers comprising a rear roller in close proximity to said friction brake means, and a plurality of other rollers spaced along the platform longitudinal axis forwardly of said rear roller, each roller having a deformable ground contact surface, said at least one other roller being of substantially the same diameter, the diameter of said rear roller being appreciably larger than the diameters of said other rollers, whereby the rear roller has larger ground contact area than each other roller, said rear roller being the primary support element for the platform when a person shifts his weight rearwardly to turn the skateboard.

2. A skateboard according to claim 1, wherein:

the diameter of said rear roller is approximately one and one-half times the diameter of each one of the other rollers.

3. A skateboard according to claim 1, wherein:

the number of said other rollers is at least three.

4. A skateboard according to claim 1, wherein:

the ground contact surface of each roller is convex in profile, whereby the platform can tilt in a direction transverse to the platform longitudinal axis without significantly reducing the roller ground contact area.

5. A skateboard according to claim 3, wherein:

the ground contact surface of each roller is convex in profile, whereby the platform can tilt in a direction transverse to the platform longitudinal axis without significantly reducing the roller ground contact area.

6. A skateboard comprising:

a platform having a longitudinal axis, an upper surface, a lower surface, and a front and rear ends, a frame structure extending from the platform lower surface, friction brake means carried by said frame structure near the rear end of the platform, and a single row of rollers supported on said frame structure on the longitudinal axis of the platform, said rollers comprising a rear roller having a fixed axis of rotation and a plurality of other rollers spaced along the platform forwardly of said rear roller, means pivotably supporting at least some of said other rollers on said frame structure, whereby said at least some of the rollers are steerable, and wherein said rear roller has a fixed axis of rotation.

7. A skateboard according to claim 6, wherein:

said rollers are pivotally supported on said frame structure and are steerable.

8. A skateboard comprising:

a platform having a longitudinal axis, an upper surface, a lower surface, and a front and rear ends, a frame structure extending from the platform lower surface, said frame structure comprises two parallel walls extending parallel to the platform longitudinal axis, friction brake means carried by said frame structure near the rear end of the platform, a single row of rollers supported on said frame structure on the longitudinal axis of the platform, said rollers comprising a rear roller and at least one other roller spaced along the platform forwardly of said rear roller, said rollers are disposed between the parallel walls so the midplanes of the rollers are normally aligned with the platform longitudinal axis, the support means for each of said plurality of rollers comprises an axle extending transversely between the parallel walls, and an annular roller support sleeve surrounding said axle, said sleeve has two aligned sockets in its inner surface, and pivot pin means extend from said axle into said aligned sockets, whereby the sleeve is pivotable about the pin means axis.

9. A skateboard comprising:

a platform having a longitudinal axis, an upper surface, a lower surface, and a front and rear ends, a frame structure extending from the platform lower surface, a single row of a plurality of rollers supported on said frame structure on the longitudinal axis of the platform, said rollers comprising a rear roller, and a plurality of other rollers spaced along the platform forwardly of said rear roller, means mounting said at least one other roller for pivoting about an axis inclined relative to the skateboard and toward the direction of forward skateboard movement, whereby said at least one roller is steerable in a direction determined by the side portion of the skateboard upon which the person exerts downward force.

10. A skateboard comprising:

a platform having a longitudinal axis, an upper surface, a lower surface, and a front and rear ends, a frame structure extending from the platform lower surface, a single row of rollers supported on said frame structure on the longitudinal axis of the platform, said rollers comprising a rear roller, and at least one other roller spaced along the platform forwardly of said rear roller, and at least some of the plurality of rollers comprising a roller body bearingly mounted on a sleeve swivelable about pin means inclined relative to said platform, and toward the direction of forward skateboard movement, whereby said at least one roller is steerable in a direction determined by the side portion of the skateboard upon which the person exerts downward force, whereby upon exertion by a person of downward force on a selected side portion of the skateboard, turning torque is produced about the axis of the inclined pin means to steer the roller toward the direction of the side of the skateboard upon which the downward force is exerted to turn the roller in said direction.

11. A skateboard according to claim 9, wherein:

each of said at least some rollers is disposed about an axle having an opening therein inclined relative to the skateboard platform, and said pin means is disposed in said inclined axle opening.

12. A skateboard according to claim 1, and further including:

yoke means for each roller pivotally mounted on said frame walls with a first end portion defining a retainer section and a second opposite end portion defining bifurcated arms, said roller being mounted for rotation between said arms, spring means disposed between said retainer section and the frame, the roller being pivoted downwardly upon encountering a depression or a drop to effect decompression of the spring means by the retainer section, and being pivoted upwardly upon encountering a bump or obstruction to effect spring means compression by the retainer section, whereby transmission of impact energy to the skateboard is substantially reduced.

13. A skateboard according to claim 7, and further including:

yoke means for each roller pivotally mounted on said frame walls with a first end portion defining a retainer section and a second opposite end portion defining bifurcated arms, said roller being mounted for rotation between said arms, spring means disposed between said retainer section and the frame, the roller being pivoted downwardly upon encountering a depression or a drop to effect decompression of the spring means by the retainer section, and being pivoted upwardly upon encountering a bump or obstruction to effect spring means compression by the retainer section, whereby transmission of impact energy to the skateboard is substantially reduced.

14. A skateboard according to claim 8, and further including:

yoke means for each roller pivotally mounted on said frame walls with a first end portion defining a retainer section and a second opposite end portion defining bifurcated arms, said roller being mounted for rotation between said arms, spring means disposed between said retainer section and the frame, the roller being pivoted downwardly upon encountering a depression or a drop to effect decompression of the spring means by the retainer section, and being pivoted upwardly upon encountering a bump or obstruction to effect spring means compression by the retainer section, whereby transmission of impact energy to the skateboard is substantially reduced.

15. A skateboard according to claim 3, wherein:

said frame structure comprises two parallel walls extending parallel to the platform longitudinal axis, said rollers are disposed between the parallel walls so the midplanes of the rollers are normally aligned with the platform longitudinal axis, each roller comprises an axle having its ends supported on the parallel walls, said brake means and said roller axles are detachably secured to the parallel walls and are removable from said walls, and a ski structure adapted to be mounted in the space between the parallel walls after removal of the brake means and the roller axles.

16. A skateboard according to claim 15, wherein:

said parallel walls have mounting holes for the roller axles, and said ski structure has holes therein alignable with the mounting holes in said walls for mounting of the ski structure by bolts extending through the aligned holes.

17. A skateboard according to claim 1, wherein:

a leading front roller is supported on said frame in an elevated position relative to the other rollers to facilitate passage over obstacles, and to facilitate maneuvers wherein only one or both leading rollers are in contact with a supporting surface.

18. A skateboard according to claim 7, wherein:

the leading front roller is supported on said frame in an elevated position relative to the other rollers to facilitate passage over obstacles, and to facilitate maneuvers wherein only one or both leading rollers are in contact with a supporting surface.

19. Apparatus according to claim 1, and further comprising:

at least one pole for grasping by the person while standing on the platform to assist the person in propelling the skateboard forwardly with minimal stress on the wrist, arm or shoulder, each pole having a handle extending generally transversely of the pole axis, whereby the person grasps the handle with the hand encircling of the handle surface, and wherein, the handle of each pole has a front section extending forwardly of the pole, and a rear section extending rearwardly of the pole, whereby the person has the palm of the hand resting on a handle upper surface with a finger encircling the front section of the handle, and with three remaining fingers encircling the rear section of the handle.

20. Apparatus according to claim 6, and further comprising:

at least one pole for grasping by the person while standing on the platform to assist the person in propelling the skateboard forwardly with minimal stress on the wrist, arm or shoulder, each pole having a handle extending generally transversely of the pole axis, whereby the person grasps the handle with the hand encircling of the handle surface, and wherein, the handle of each pole has a front section extending forwardly of the pole, and a rear section extending rearwardly of the pole, whereby the person has the palm of the hand resting on a handle upper surface with a finger encircling the front section of the handle, and with three remaining fingers encircling the rear section of the handle.

21. Apparatus according to claim 19, wherein:

said rear handle section is longer than said front handle section.

22. Apparatus according to claim 19, wherein:

each pole comprises two separable pole sections, each pole section having a length about the length of the skateboard.

23. Apparatus according to claim 19, and further including:

a deformable cap at the end of said at least one pole and having a relatively flat bottom surface for maintaining area contact with a supporting surface when the pole is inclined in various orientations relative to the supporting surface.

24. Apparatus according to claim 20, and further including:

a deformable cap at the end of said at least one pole and having a relatively flat bottom surface for maintaining area contact with a supporting surface when the pole is inclined in various orientations relative to the supporting surface.

25. Apparatus according to claim 22, and further including:

a deformable cap at the end of said at least one pole and having a relatively flat bottom surface for maintaining area contact with a supporting surface when the pole is inclined in various orientations relative to the supporting surface.

* * * * *